United States Patent [19]

Koschlig et al.

[11] Patent Number: 4,917,772

[45] Date of Patent: Apr. 17, 1990

[54] OVEN DOOR ASSEMBLY

[75] Inventors: Hans-Joachim Koschlig; Lothar Brandau, both of Bochum, Fed. Rep. of Germany

[73] Assignee: Dr. C. Otto Feuerfest GmbH, Bochum, Fed. Rep. of Germany

[21] Appl. No.: 272,560

[22] Filed: Nov. 16, 1988

[30] Foreign Application Priority Data

Nov. 17, 1987 [DE] Fed. Rep. of Germany ..... 3739452

[51] Int. Cl.[4] ..... C10B 25/02; C10B 25/06

[52] U.S. Cl. ..... 202/242; 110/173 R; 202/248; 202/267.1; 202/268

[58] Field of Search ..... 202/242, 248, 267 R, 202/268; 126/191, 192; 110/173 R; 122/498

[56] References Cited

U.S. PATENT DOCUMENTS

| | | | |
|---|---|---|---|
| 2,480,241 | 8/1949 | Hensel | 72/101 |
| 4,086,145 | 4/1978 | Muller | 202/248 |
| 4,118,284 | 10/1978 | Bowman et al. | 202/248 |
| 4,217,177 | 8/1980 | Gerding et al. | 202/248 |
| 4,744,867 | 5/1988 | Suey | 202/248 |

FOREIGN PATENT DOCUMENTS

| | | |
|---|---|---|
| 0028679 | 6/1983 | European Pat. Off. . |
| 0058320 | 5/1985 | European Pat. Off. . |
| 0071280 | 7/1985 | European Pat. Off. . |
| 489249 | 12/1929 | Fed. Rep. of Germany . |
| 2945017 | 5/1981 | Fed. Rep. of Germany . |
| 3219357 | 11/1983 | Fed. Rep. of Germany . |
| 3447187 | 7/1986 | Fed. Rep. of Germany . |
| 3505551 | 8/1986 | Fed. Rep. of Germany . |

*Primary Examiner*—Joye L. Woodard

*Attorney, Agent, or Firm*—Thomas N. Ljungman

[57] ABSTRACT

An oven door assembly of a shield-type construction for vented oven doors is achieved by ceramic barrier plates which can be produced in an extrusion process and which are mounted to supports, preferably in the form of cantilever beams fixed with one end to the oven door body and bearing clamps at the other end for clamping the ceramic barrier plates. Each ceramic barrier plate is replaceable and has grooves on the upper and lower side faces to receive the clamps. The clamps are constructed for clamping the ceramic barrier plates by pressure forces acting normal to the upper and lower side faces of the ceramic plates.

9 Claims, 4 Drawing Sheets

OVEN DOOR ASSEMBLY

BACKGROUND OF THE INVENTION

1. Field of the Invention

The invention relates to an oven door assembly for industrially used ovens, which oven door assembly is built up by ceramic barrier plates in a shield-type construction so as to form a distance between the ceramic barrier plates and the oven door body which distance is used as a gas channel for oven gas. The invention further relates to the ceramic barrier plates themselves.

2. Description of Prior Art

In U.S. Pat. No. 4,086,145 a coke oven door lining assembly is shown which is formed by a metallic barrier made from one I-beam which is mounted to the coke oven door body with one of the beam flanges, the other flange directing towards the coke oven interior.

The use of a metallic door assembly has in practice turned out to be disadvantageous because of the relatively high thermal expansion coefficient of the materials, mainly steel, which has been used so far. During the heating and cooling cycles in the coke oven operation the metallic very often underlies strong deformation which is due to thermal stresses and related strains and fatigue. This also very often led to blockage of the gap between the metallic barrier and the side walls of the coke oven chamber, thus disturbing the function of the gas collecting channel which acts as a pressure relief channel so as to reduce leakage through the coke oven door seal.

In the description of U.S. Pat. No. 4,217,177 a vented coke oven door apparatus is described which is constructed as a plug-type coke oven door forming a central vertical channel which is open at the top and the bottom of the plug only. The plug is formed by U-shaped ceramic bricks which are mounted with the open side directing towards the coke oven door body so that the inner surface of the U-shaped cross section forms the gas collecting channel. The bricks were supplied with recesses to receive mounting devices, especially a T-shaped bolt or for a screw with a hook-shaped end. The disadvantage of this type of construction is that the coke oven gas can enter the gas collecting channel only at the bottom of the coke oven door. Additionally, it is a major drawback of this type of construction that the U-shaped bricks, especially with the recesses for mounting devices, are very costly in the production.

From the published German patent application DE-OS No. 34 47 187 it is known to use the shield type construction for coke oven doors using replacable plates made of refractory concrete. This shield type construction consists of several ceramic front plates or barrier plates arranged vertically above each other, each of which is partly surrounded by a steel frame, each of which is mounted by three cantilever beams in a distance to the coke oven door body. Each steel frame has tie rod anchors embedded in the ceramic plate. In respect of the thermal conditions in the coke oven during coke production, especially the cyclic heating and cooling of the coke oven door, this type of mounting is disadvantageous because of the different thermal expansion of metallic and ceramic parts in the front plates.

SUMMARY OF THE INVENTION

It is an object of the present invention to provide an oven door assembly in shield-type construction with a gas channel wherein the shield forming parts are ceramic barrier plates or front plates which are easy to replace and can be mounted to supporting means fixed to the coke oven door body without having any metallic mounting device to be formed into the ceramic barrier plate.

According to the present invention there is provided an oven door assembly in an arrangement suitable to form a gas channel between the ceramic barrier plates and the coke oven door body, thus forming a so called vented oven door, and further clamping devices are provided to clamp the ceramic barrier plates at two side faces, opposite to each other.

More particularly, the invention provides a lining in form of replacable ceramic barrier plates. Each plate extends almost completely from one side of the door opening to the other. A plurality of barrier plates are arranged above each other. Each plate has a profile along two side faces opposite to each other which runs continuously along the length of the side faces and which is especially designed for the production of the ceramic barrier plates in an extrusion process, in which a plastified ceramic mass is extruded by an auger machine through an extrusion die having the cross-section of a barrier plate, and cutting the extruded green clot to a required length. Thereupon the green clot is dried and fired.

Very particularly, the profile at the side faces of the plate opposite to each other is designed as a groove of U-shaped cross section with a generally circular bottom section to receive generally cylindrical parts of the clamping devices which are part of or mounted to supporting means fixed to the oven door body. One of the clamping devices is adjustable in the direction which is normal to the side faces of the ceramic barrier plate to be clamped by pressure force acting into this direction for holding the plates in their position. Preferably the upper and lower side faces are formed with grooves. The profiles or the grooves are formed in the extrusion process.

In a preferred embodiment of the invention the oven door assembly is a coke oven door assembly and the gas channel is a channel for collecting coke oven gas.

DETAILED DESCRIPTION OF THE DRAWINGS

Figure 1:
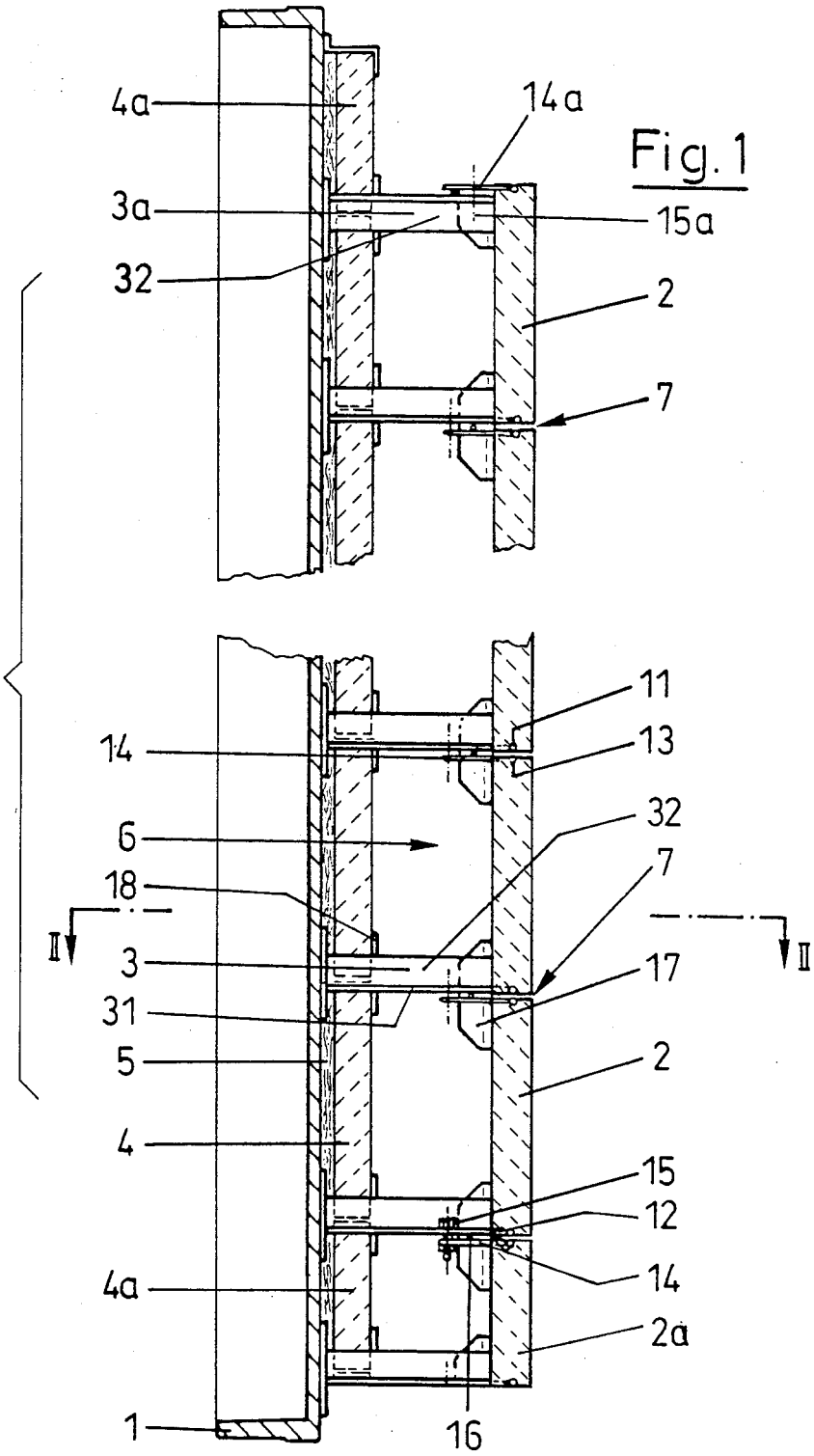
FIG. 1 is a vertical cross sectional view of an embodiment of a coke oven door assembly according to the invention, with cantilever beams as supporting means fixed to the coke oven door body and with clamping devices for the clamping of ceramic barrier plates at their free ends, and the ceramic barrier plates arranged vertically above each other.
Figure 2:
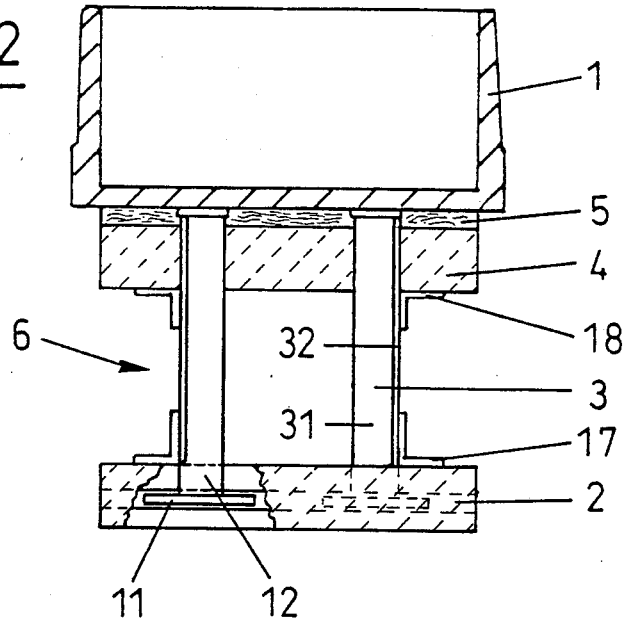
FIG. 2 is a horizontal cross-sectional view along II—II of the coke oven door assembly of FIG. 1.
Figure 3:
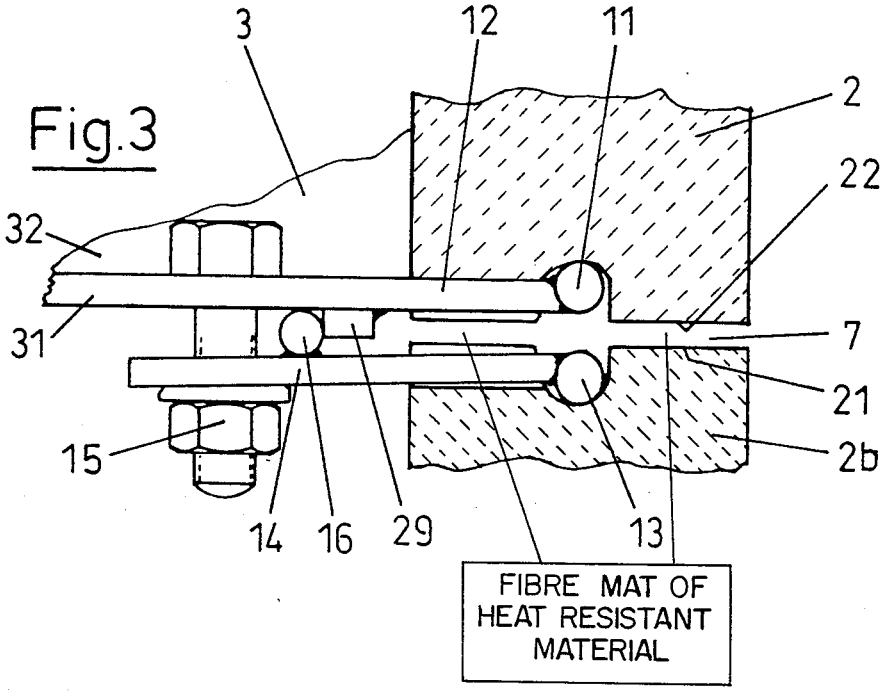
FIG. 3 is a partial sectional view in enlarged scale similar to FIG. 1 illustrating the clamping devices which are part of or mounted to a cantilever beam so as to hold two ceramic barrier plates arranged vertically above each other.

FIGS. 1 and 2 show a coke oven door assembly with a coke oven door body 1 with ceramic barrier plates 2, 2*a* to form the shield-type construction, and which plates are supported by iron cantilever beams 3, 3*a* of L-shaped cross section in a distance to the coke oven door body 1 to form a gas collecting channel 6. To reduce heat losses through the coke oven door body 1 lightweight refractory bricks 4, 4a are arranged on the door body 1 whereby a ceramic fibre mat 5 is embedded between the lightweight refractory bricks 4, 4*a* and the coke oven door body 1 itself. Between adjacent ceramic barrier plates 2, 2*a* remain gaps 7 which can be closed by a fibre mat of heat resistant material (as indicated in FIG. 3). At the upper side face 21 (FIG. 5) and the lower side face 22 (FIG. 5) of each ceramic barrier plate 2, 2*a* grooves 23 (FIG. 5) have been formed which receive claw-like steel rods 11 and 13 of clamping devices 12, 14, 14*a* for clamping. Instead of steel rods 11, 13 fixed to the clamping devices 12, 14, 14*a*, claw-like clamping devices with bended ends can be used as well. The clamping devices 12, 14, 14*a* are part of or arranged at the supporting cantilever beam 3, 3*a*. The lower clamping device 12 is arranged at the lower side face of a barrier plate 2, 2*a*. The upper clamping device 14, 14*a* is arranged at the upper side face of a barrier plate 2, 2*a*. The upper clamping device 14, 14*a* is connected by a screw connection 15 to the horizontal flange 31 of the L-shaped cross section of the cantilever beam 3, 3*a*. Between the screw connection 15 and the steel rod 13 a steel rod 16 serves as a fulcrum so that tightening of the screw connection 15 at one end of the upper clamping device 14 moves the other end downwards, the upper clamping device 14 thus acting as a lever, which serves for clamping the ceramic barrier plate 2, 2*a* against its lower clamping device 12. Additionally supporting angles 17, 18 are mounted at the supporting cantilever beam 3, 3*a* so as to secure the ceramic barrier plates 2, 2*a* and the lightweight refractory bricks 4, 4*a* against displacement in horizontal direction into the coke oven gas collecting channel 6. The uppermost of the ceramic barrier plates 2 is clamped by a clamping device 14*a* which is fixed by a screw connection 15*a* to a cantilever beam 3*a* which has no section 12 extending between two plates and has its vertical face 32 directing downwards. For this type of holding device no steel rod is used as a fulcrum between the screw connection 15*a* and the steel rod 11. Instead of cantilever beams with L-shaped cross-section, cantilever beams with other cross-sections, such as circular or oval may be used.

FIG. 3 shows the supporting cantilever beam 3 of L-shaped cross section, the horizontal flange 31 of which extends as a clamping element 12 into the space 7 between two ceramic barrier plates 2, 2*b*. At the end of the clamping device 12, an iron rod 11 is attached which engages the groove 23 (FIG. 5) at the lower side face 22 of the upper ceramic barrier plate 2. The upper clamping device 14 is arranged generally parallel to the horizontal flange 31 of the steel cantilever beam 3. At the end of the clamping device 14 directing towards the ceramic barrier plate 2 a steel rod 13 is attached, which engages the groove 23 of the upper side face 21 of the lower plate 2*b*. At the other end of the clamping device 14 a screw connection 15 mounts the clamping device 14 to the cantilever beam 3. Between the screw connection 15 and the steel rod 13 a steel rod 16 is attached to the clamping device 14 which acts as a fulcrum.

Figure 5:
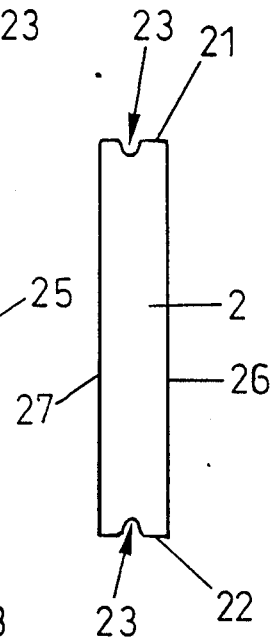
FIG. 5 is a side view of the prefered embodiment of the ceramic barrier plate of FIG. 4 with a groove on two opposite side faces.

A securing element 29 against horizontal displacement of the upper clamping device 14 is fixed to the horizontal flange 31 of the L-shaped cantilever beam 3. The ceramic barrier plates 2, 2*a* are clamped simply by pressure forces acting on two side faces 21, 22 which are opposite to each other, without any metallic parts having to be formed into the plates themselves. For replacement of one ceramic barrier plate 2*b*, one simply has to unscrew the screw connection 15 and to push up the clamping device 14 to move the steel rod 13 out of the groove 23 (FIG. 5). The ceramic barrier plate 2*b* to be replaced can then be tilted away from supporting angle 17 (FIG. 1) and lifted from the lower clamping element 12. The gap 7 is especially in the part of the side faces 21, 22 where it receives the clamping devices 12 and 14 designed to allow the replacement by tilting and lifting the ceramic barrier plate. The securing element 29 hinders the upper clamping device 14 from falling into the coke oven chamber in case of breakage of the screw connection 15. The securing element 29 also serves as a construction aid for the mounting of the clamping device 14. An additional construction aid similar to the securing element 29 can be placed on the other side of the steel rod 16 opposite to the securing element 29.

Figure 4:
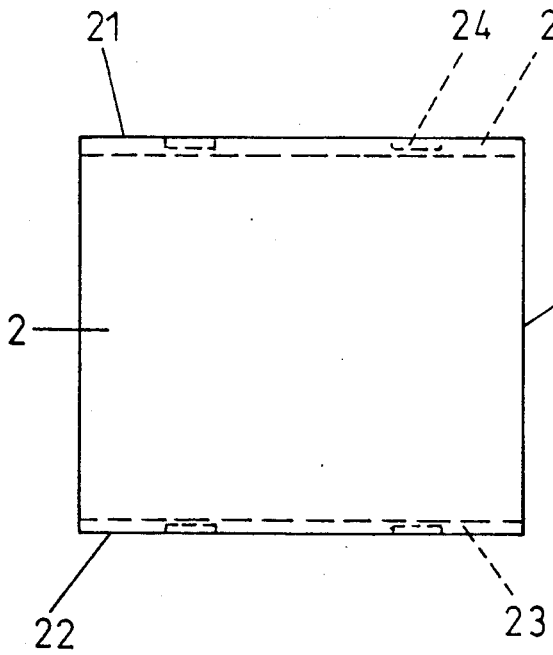
FIG. 4 is a view of the front side of a ceramic barrier plate facing the coal charge, the ceramic barrier plate having a groove running along two side faces which are opposite to each other and are suited to receive clamping devices.

FIGS. 4 and 5 show a ceramic barrier plate 2 with upper and lower side faces 21, 22 with grooves 23, planar vertical side faces 25, planar front face 26 to be directed to the coal charge, planar back face 27 to be directed to the gas channel 6, and recesses 24 to receive the lower clamping device 12 and the upper clamping device 14. No recesses are necessary if the gap 7 between two barrier plates is broader than the thickness of clamping elements 12, 13. In any case, the gap 7 (FIG. 3) should be broad enough to remove a barrier plate after unscrewing the screw connection 15 and lifting upper clamping device 14 with steel rod 13 against lower clamping device 12 with steel rod 11.

The ceramic barrier plates 2 are preferably manufactured by extrusion, cutting, drying, and subsequent firing of a refractory raw material which consists of or at least contains cordierite for better thermal shock resistance and low thermal expansion. Additionally, the preferred ceramic barrier plates 2 can be provided with front sides thereof which are glazed to improve chemical resistance.

For a manufactured coke oven door assembly the ceramic barrier plates were about 500 mm wide, 450 mm high, and 80 mm thick, and the total height of the door was more than 4000 mm. However, the dimensions of the plates have to be adapted to the door body.

Figure 6:
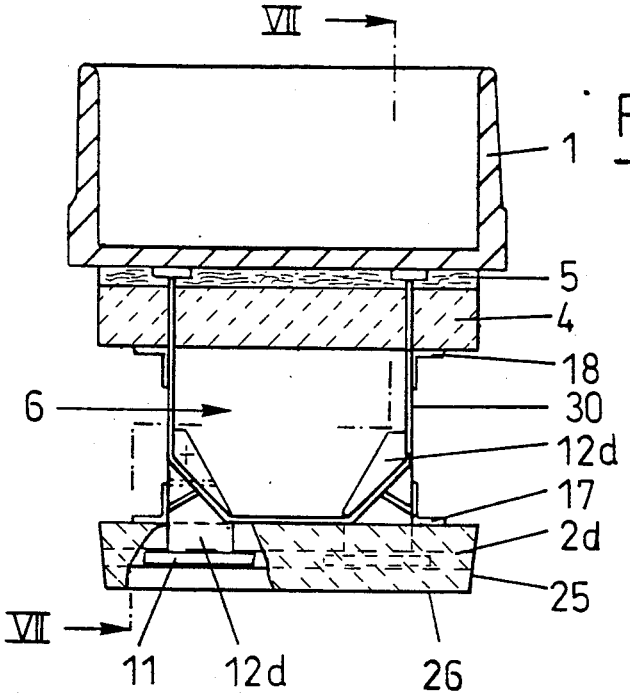
FIG. 6 is a horizontal cross-sectional view of the coke oven door assembly similar to FIG. 1 but illustrating a second embodiment of supporting means in form of bow-shaped flat iron fixed to the coke oven door body and supporting the clamping devices for a ceramic barrier plate.
Figure 7:
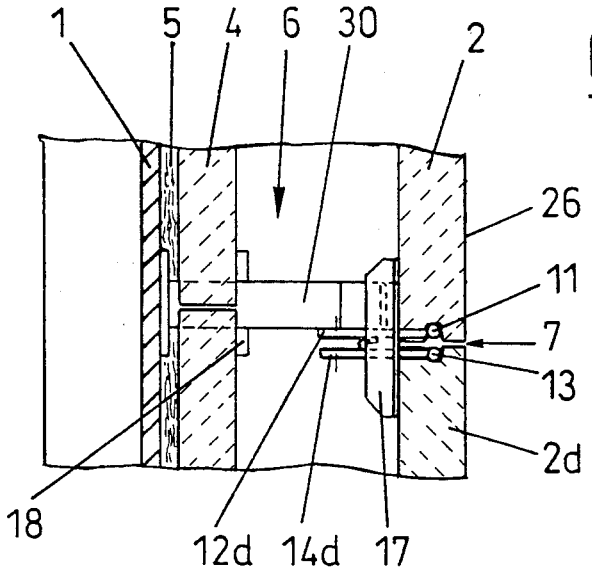
FIG. 7 is a vertical cross-sectional view along VII—VII of the coke oven door assembly of FIG. 6.

FIGS. 6 and 7 show another embodiment of the supporting means of the invention. Instead of cantilever beams a bow-shaped bended flat iron 30 is fixed to the coke oven door body 1 and bears a lower clamping device 12*d*, in the form of a steel plate, to which the upper clamping device 14*d*, in the form of a steel plate, is mounted, similar to the way described before. FIG. 6 shows additionally ceramic barrier plates 2*d* of a conical cross section where the angle included by the frontside 26 of the ceramic barrier plate 2*d* facing to the coal charge and by the vertical side face 25 is greater than 90 degrees. The conical form of the ceramic barrier plate facilitates the closing of the coke oven door in case of diminished spacing between the ceramic barrier plate 2*d* and the side walls of the coke oven which are not shown in the figure.

Figure 8:
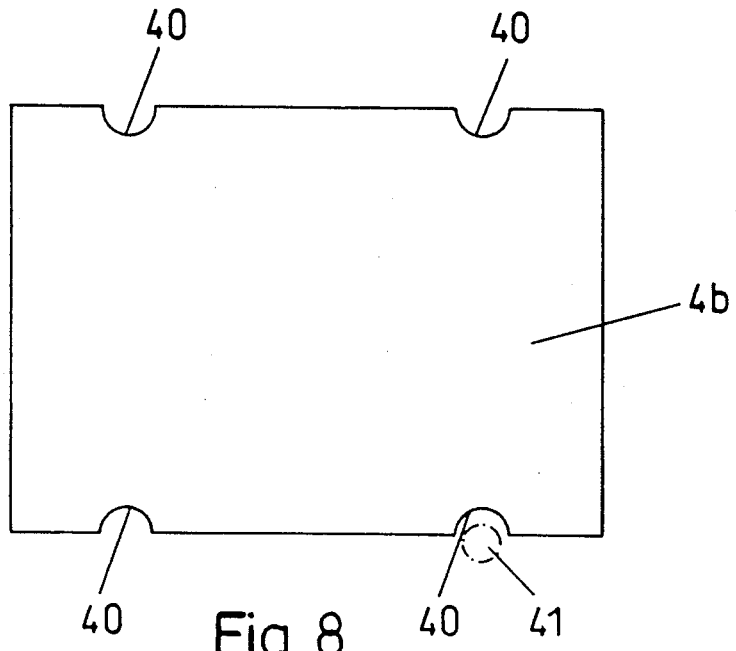
FIG. 8 is a front view of a lightweight refractory brick for heat insulation of the oven door body.

FIG. 8 shows an embodiment of a lightweight refractory brick 4*b* for heat insulation of the coke oven door body with special recesses 40 of half-circle-shaped cross-section for cylindrical cantilever beams 41, which may be made of cast iron and used instead of L-shaped cantilever beams as shown in FIGS. 1 to 3.

For proper opening and closing operation of the oven door and safe operation during the applied oven process it is essential to have a ceramic material for the ceramic barrier plates which combines high mechanical strength, high-temperature shock resistance, and a low thermal expansion coefficient and which is also suitable for production in an extrusion process which is advantageous for an improved ceramic structure of the barrier plates. According to the invention cordierite containing material is used for the ceramic barrier plates. For heat insulation of the oven door body lightweight refractory bricks in standardised brick formats or bricks with special recesses for the supporting elements can be used. For the lightweight refractory bricks preferably also cordierite is added to the ceramic material.

What is claimed is:

1. An oven door assembly including a door body and a vertical arrangement of barrier plates spaced apart from an inner side of said door body to form a gas channel, which assembly comprises:

a plurality of ceramic barrier plates, a plurality of supporting means, a plurality of clamping devices, and a plurality of mounting elements in which each of said ceramic barrier plates has a planar front side directed to an interior of an oven, a planar backside directed to the gas channel, planar vertical side faces, and upper and lower side faces having a profile running continuously over the length of said upper and lower side faces, in which said supporting means are fixed to said door body and extend through the gas channel to the barrier plates, and in which each of said clamping devices includes a lower and upper clamping device joined to and extending from a respective one of said supporting means into a gap between two vertically adjacent ceramic barrier plates of said plurality of ceramic barrier plates arranged above each other, said lower clamping device engaging the profile of the lower side face of a first barrier plate of said two ceramic barrier plates which is thereby supported by said lower clamping device and said one supporting means, and said upper clamping device being releasably pressed against the upper side face of a second barrier plate of said two ceramic barrier plates by a respective one of said mounting elements which is disposed in a first position of at least two positions for causing said upper clamping device to thereby removably engage the profile of said upper side face, so that each of the ceramic barrier plates can be replaced by releasing the upper clamping device of each of said clamping devices when each of said mounting elements is disposed in a second position of said at least two positions.

2. The oven door assembly of claim 1 wherein said profile running continuously over the length of said upper and lower side faces is a groove, said upper and lower clamping devices have claw-like ends to fit into said grooves, said upper clamping devices are mounted generally parallel to and below said lower clamping devices by said mounting elements in said first position, said mounting elements comprise a screw connection connecting said upper and lower clamping devices which said screw connection is placed at an end of said upper clamping devices that is opposite to said claw-like ends, and a steel rod as a fulcrum which is placed generally in the middle of said upper clamping devices between said claw-like ends and said opposite ends to be located between said upper and said lower clamping devices.

3. The oven door assembly of claim 2 wherein said supporting means are cantilever beams fixed to said oven door body.

4. The oven door assembly of claim 2, wherein said supporting means are bow-shaped bended elements having a first end and a second end, said first end is fixed to said oven door body and said second end includes a steel plate which is attached thereto to form said lower clamping device.

5. The oven door assembly of claim 1 wherein said ceramic barrier plates contain cordierite to provide good temperature shock resistance and have said front sides thereof which are glazed to improve chemical resistance.

6. The oven door assembly of claim 5, wherein said ceramic barrier plates have a horizontal cross-section of a conical form with angles between the front side and the vertical side faces, which angles include more than 90 degrees.

7. The oven door assembly of claim 1, further including a heat-resistant fibre mat to fill said gap between adjacent ceramic barrier plates.

8. The oven door assembly of claim 1, further including a lining of heat insulating lightweight refractory bricks on said inner side of said oven door body, wherein said lining of bricks has recessed areas for disposition of said supporting means therethrough and said bricks contain cordierite to provide good temperature shock resistance.

9. The oven door assembly of claim 8, further including a heat-resistant fibre mat which is placed between said coke oven door body and said lining of heat insulating lightweight refractory bricks.

* * * * *